United States Patent [19]

Ishihara et al.

[11] Patent Number: 5,050,565

[45] Date of Patent: Sep. 24, 1991

[54] FUEL CONTROL SYSTEM FOR ENGINE

[75] Inventors: Toshihiro Ishihara; Tetsushi Hosokai; Tetsuro Takaba; Hideki Kobayashi, all of Hiroshima, Japan

[73] Assignee: Mazda Motor Corporation, Hiroshima, Japan

[21] Appl. No.: 627,816

[22] Filed: Dec. 14, 1990

[30] Foreign Application Priority Data

Dec. 15, 1989 [JP] Japan ..... 1-326447

[51] Int. Cl.[5] ..... F02D 41/18

[52] U.S. Cl. ..... 123/494; 123/480; 123/488

[58] Field of Search ..... 123/478, 480, 488, 492, 123/494; 73/118.2; 364/431.05, 431.07

[56] References Cited

U.S. PATENT DOCUMENTS

| | | | |
|---|---|---|---|
| 4,702,214 | 10/1987 | Wataya | 123/488 |
| 4,706,631 | 11/1987 | Wataya | 123/488 |
| 4,727,845 | 3/1988 | Misumi et al. | 123/488 |
| 4,805,577 | 2/1989 | Kanno et al. | 123/488 |
| 4,807,581 | 2/1989 | Nishikawa et al. | 123/488 |
| 4,870,937 | 10/1989 | Sanbuichi et al. | 123/488 |
| 4,911,128 | 3/1990 | Hara et al. | 123/488 |
| 4,986,244 | 1/1991 | Kobayashi et al. | 123/488 |

FOREIGN PATENT DOCUMENTS 60-17939 5/1985 Japan .

*Primary Examiner*—Willis R. Wolfe

*Attorney, Agent, or Firm*—Sixbey, Friedman, Leedom & Ferguson

[57] ABSTRACT

An airflow meter detects an amount of intake air flowing through an intake passage of the engine, and a fuel injector injects fuel in an amount which is determined according to the amount of intake air detected by the airflow meter. A controller calculates moving averages of outputs of the airflow meter, and the ratio of the difference between each output of the airflow meter and the moving average to a value derived from the moving average. The controller causes the fuel injector to increase the amount of fuel to be fed to the engine when the ratio is not smaller than a predetermined reference threshold value.

5 Claims, 6 Drawing Sheets

FUEL CONTROL SYSTEM FOR ENGINE

BACKGROUND OF THE INVENTION

1. Field of the Invention

This invention relates to a fuel control system for an engine, and more particularly to a fuel control system for an engine in which the amount of fuel to be fed to the engine is increased upon acceleration.

2. Description of the Prior Art

There has been known a fuel control system for an engine in which the amount of fuel to be injected is determined on the basis of the amount of intake air detected by an airflow meter, and fuel is injected for each cylinder or for all the cylinders at a predetermined timing.

In the fuel control system disclosed, for instance, in Japanese Patent Publication No. 60(1985)17939, additional fuel is injected out of the timing when the engine is being accelerated.

In order to effect such acceleration fuel increase, it is necessary to determine that the engine is being accelerated. Conventionally it is determined that the engine is being accelerated when the rate of change (dQa/dt) of the amount of intake air Qa as detected by the airflow meter exceeds a reference threshold value $\alpha_o$.

When a hot-wire type airflow meter or a film type airflow meter is used for detecting the amount of intake air, the output of the airflow meter pulsates. In order to compensate for influence of the pulsation of the output of the airflow meter, it has been proposed to smooth the output of the airflow meter and to determine whether the engine is being accelerated by the use of the difference between the actual amount of intake air and the smoothed value of the amount of intake air.

As shown in FIG. 6, the output of the hot-wire type airflow meter Qa pulsates accompanied by overshoot upon acceleration of the engine and the rate of change with time of the output of the airflow meter is greatly affected by the pulsation. Accordingly when the reference threshold value $\alpha_o$ is relatively small, misjudgement can be caused due to the pulsation. Accordingly, conventionally, the reference threshold value $\alpha_o$ is set to be large. As a result, acceleration of the engine is detected and the acceleration fuel increase is performed after a substantial delay from the time the throttle valve begins to be opened, whereby acceleration response is lowered and acceleration shock is caused.

Further in the case of acceleration from a state where the amount of intake air is small, the amplitude of the pulsation of the output of the airflow meter is large, and accordingly, it is preferred that the reference threshold value $\alpha_o$ be set to be larger. On the other hand, in the case of acceleration from a state where the amount of intake air is large, the amplitude of the pulsation of the output of the airflow meter is small and there is less possibility of misjudgement, and accordingly it is preferred that the reference threshold value $\alpha_o$ be set to be small.

However, since the value of the reference threshold value $\alpha_0$ is conventionally fixed irrespective of the amount of intake air, acceleration response is lowered though misjudgement can be avoided when the reference threshold value $\alpha_o$ is too large while misjudgement occurs frequently due to the pulsation of the output of the airflow meter when the reference threshold value $\alpha_o$ is too small.

SUMMARY OF THE INVENTION

In view of the foregoing observations and description, the primary object of the present invention is to provide a fuel control system for an engine in which acceleration of the engine can be quickly and accurately detected irrespective of the amount of intake air, whereby fuel can be increased with a quick response to acceleration and the acceleration shock can be suppressed.

In accordance with the present invention, there is provided a fuel control system for an engine comprising an airflow meter which detects an amount of intake air flowing through an intake passage of the engine, a fuel feed means for feeding fuel to the engine in an amount which is determined according to the amount of intake air detected by the airflow meter, a moving average calculating means which calculates moving averages of outputs of the airflow meter, a ratio calculating means which calculates the ratio of the difference between each output of the airflow meter and the moving average to a value derived from the moving average, and a fuel increase means which causes the fuel feed means to increase the amount of fuel to be fed to the engine when the ratio is not smaller than a predetermined reference threshold value.

When the actual output of the airflow meter, the moving average and the value derived from the moving average are respectively represented by Qa, Qs and Qse, the ratio calculated by the ratio calculating means is represented as follows.

$$R=(Qa-Qs)/Qse$$

As the value Qse derived from the moving average, various values can be employed. For instance, it may be the moving average itself, or a value obtained by subtracting an output of the airflow meter which represents the amount of intake air during idling from the moving average.

When the engine is being accelerated, the amount of intake air or the output Qa of the airflow meter increases at a higher rate than the moving average Qs and the value Qse, and accordingly the ratio R increases. After the acceleration is completed, the moving average Qs approaches the actual output Qa of the airflow meter and accordingly, the ratio R does not increase greatly even if the difference Qa−Qs increases due to pulsation of the output of the airflow meter. Accordingly, when the reference threshold value is set to a proper value, the acceleration of the engine can be accurately detected without misjudgement due to the pulsation of the output of the airflow meter.

Further, when the engine is accelerated from a state where the amount of intake air is relatively small and the moving average Qs is small, the value of the ratio R quickly increases and accordingly, acceleration of the engine can be quickly detected, whereby the acceleration fuel increase can be performed in a short time after the beginning of the acceleration.

DESCRIPTION OF THE PREFERRED EMBODIMENT

Figure 1:
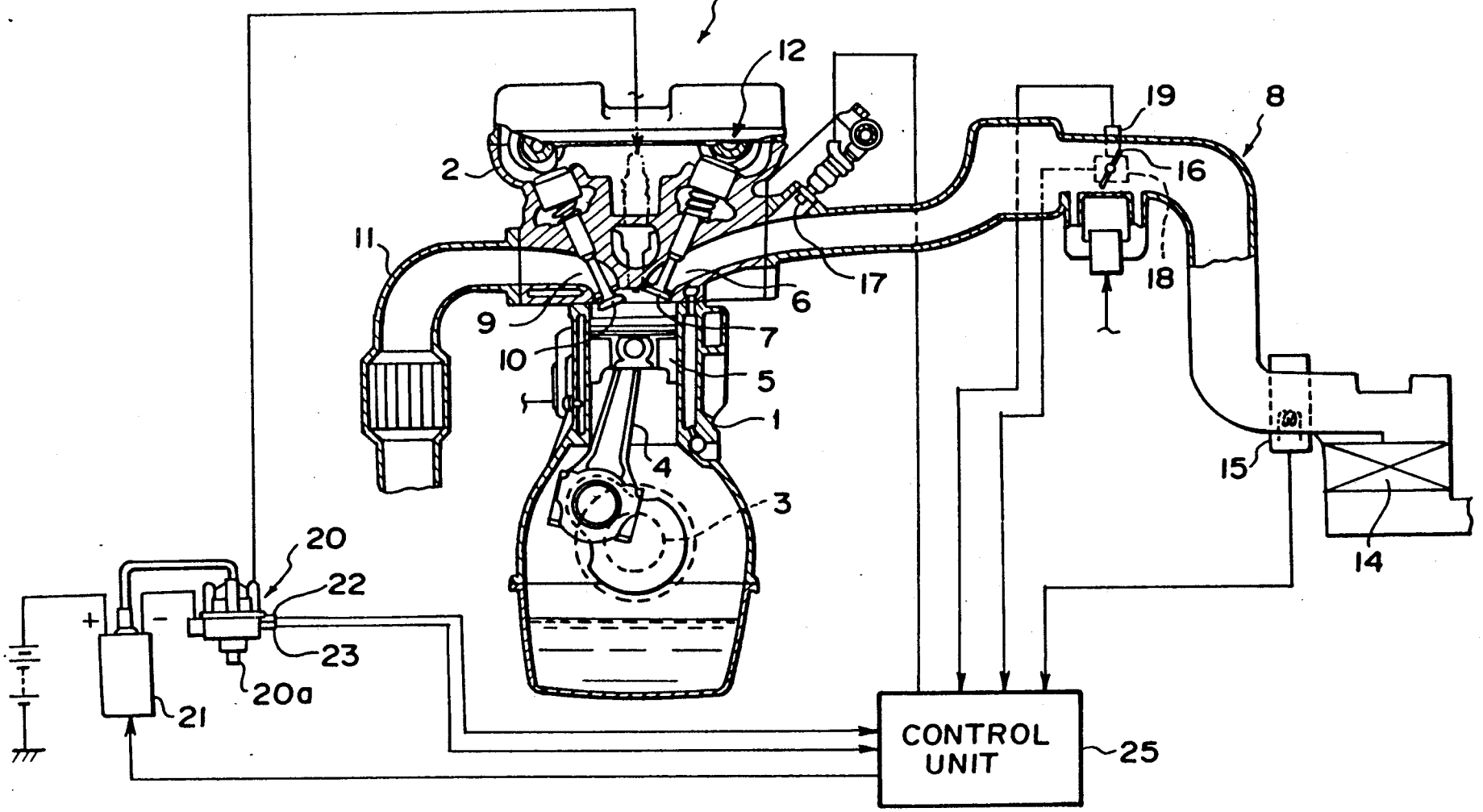
FIG. 1 is a schematic view showing an engine provided with a fuel control system in accordance with an embodiment of the present invention.

In FIG. 1 which shows a four-cylinder in-line engine E provided with a fuel control system in accordance with an embodiment of the present invention, reference numerals 1 to 12 respectively denote a cylinder block, a cylinder head, a crankshaft, a connecting rod, a piston, an intake port, an intake valve, an intake passage, an exhaust port, an exhaust valve, an exhaust passage and a valve driving mechanism.

An air cleaner 14, a hot wire airflow meter 15, a throttle valve 16 and a fuel injector 17 are disposed in the intake passage 8 in this order from the upstream side.

A distributor 20 is electrically connected to an ignition unit 21. The distributor 20 has a rotational shaft 20*a* which are connected to the crankshaft 3 by way of a mechanism which is not shown so that it makes one revolution for every two revolution of the crankshaft 3. A disk is connected to the rotational shaft 20*a* of the distributor 20, and a crank angle sensor 22 detects the speed of revolution of the rotational shaft 20*a* and a reference crank angle sensor 23 detects TDC of the compression stroke of a reference cylinder (e.g., number one cylinder) by way of the disk.

Signals from the airflow meter 15, a throttle opening sensor 18 for detecting the opening of the throttle valve 16, an idle switch 19, the crank angle sensor 22, the reference crank angle sensor 23, and other sensors and switches which are not shown are input into a control unit 25 which controls the engine E. The control unit 25 outputs control signals to the ignition unit 21, the fuel injector 17 and the like.

Figure 2:
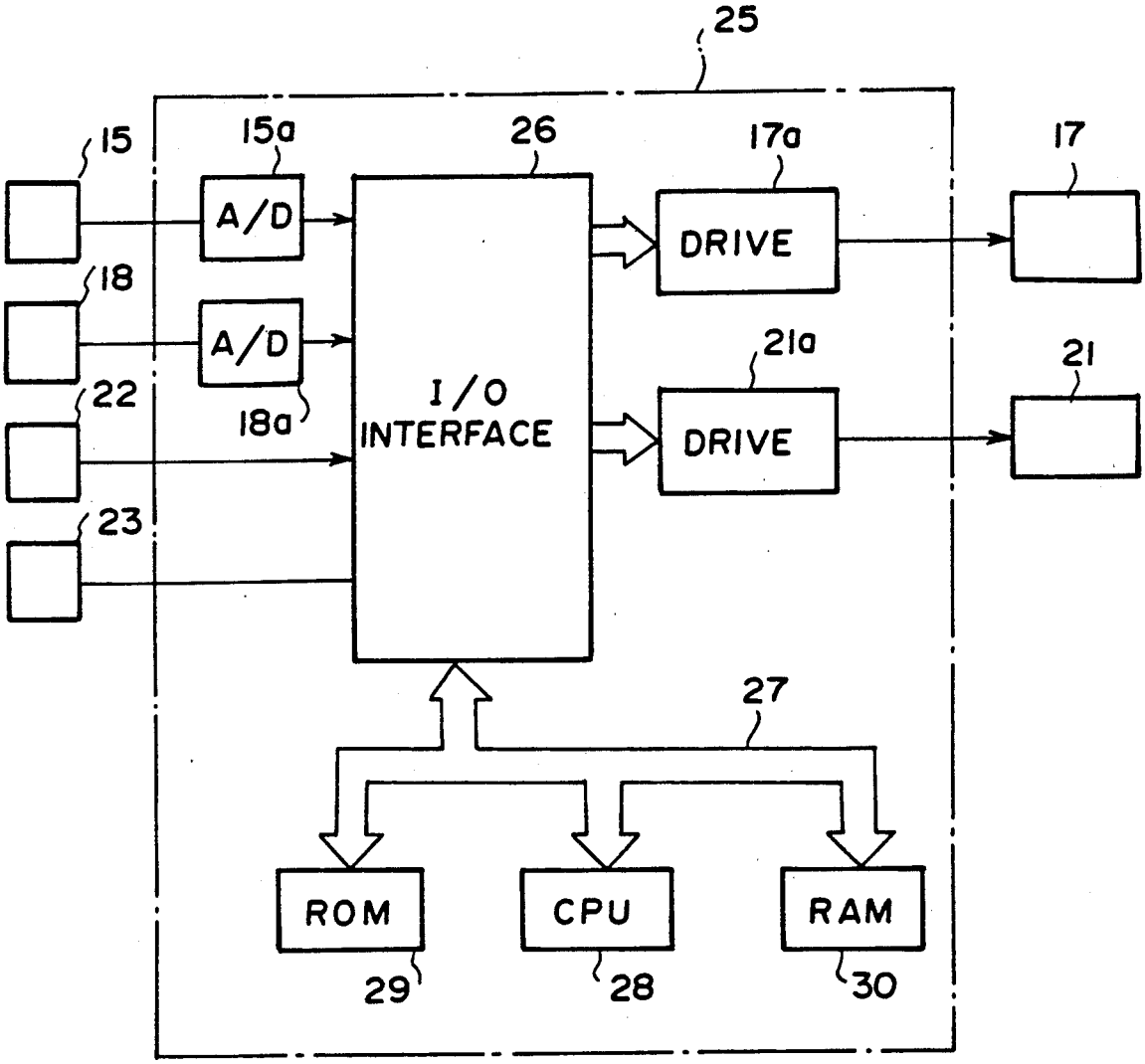
FIG. 2 is a block diagram showing the control unit.

The control unit 25 comprises, as shown in FIG. 2, an input/output interface 26, a microcomputer having a CPU (central processing unit) 28, a ROM (read-only memory) 29 and a RAM (random access memory) 30 which are connected to the input/output interface 26 by way of a bus 27 such as a data bus, A/D convertors 15*a* and 18*a* which are respectively connected between the interface 26 and the airflow meter 15 and between the throttle opening sensor 18 and the interface 26, an injector driving circuit 17*a* for driving the injector 17 and an ignition unit driving circuit 21 for driving the ignition unit 21.

An ignition timing control program, a map of a basic ignition timing advance angle used in the ignition timing control, a fuel injection control program for calculating the amount of fuel to be injected from the injector 17 and driving the injector 17, a map of a basic injection amount used in the fuel injection control, an acceleration fuel increase control program to be described later, and other various control programs such as an idling speed control program have been stored in the ROM 29.

The ignition timing control and the fuel injection control may be carried out in a known manner and will not be described in detail here though the fuel injection control will be just briefly described, hereinbelow.

In the fuel injection control, the engine speed Ne is detected on the basis of the crank angle signal from the crank angle sensor 22, and the intake air charging amount for one cylinder on the basis of the output signal of the airflow meter 15 and the engine speed Ne. Then a basic injection amount FBASE corresponding to the engine speed Ne and the intake air charging amount is read out from the map of the basic injection amount, and a final injection amount TF is determined according to formula TF=FBASE+CFB, wherein CFB represents a feedback correction amount. The feedback correction amount CFB is determined on the basis of an output of an air-fuel ratio sensor (not shown) in an well known manner.

Further, timings at which the four injectors 17 are driven are determined on the basis of the reference crank angle signal from the reference crank angle sensor 23 and the engine speed Ne, and a driving pulse having an width corresponding to the final injection amount TF is output to the injectors 17 at the respective timings.

The acceleration fuel increase control program will be described with reference to FIGS. 3 to 5, hereinbelow. The interruption handling routines shown in FIGS. 3 and 4 are executed by interruption of the main routine (the ignition timing control and/or the fuel injection control) every 5 msec.

Figure 3:
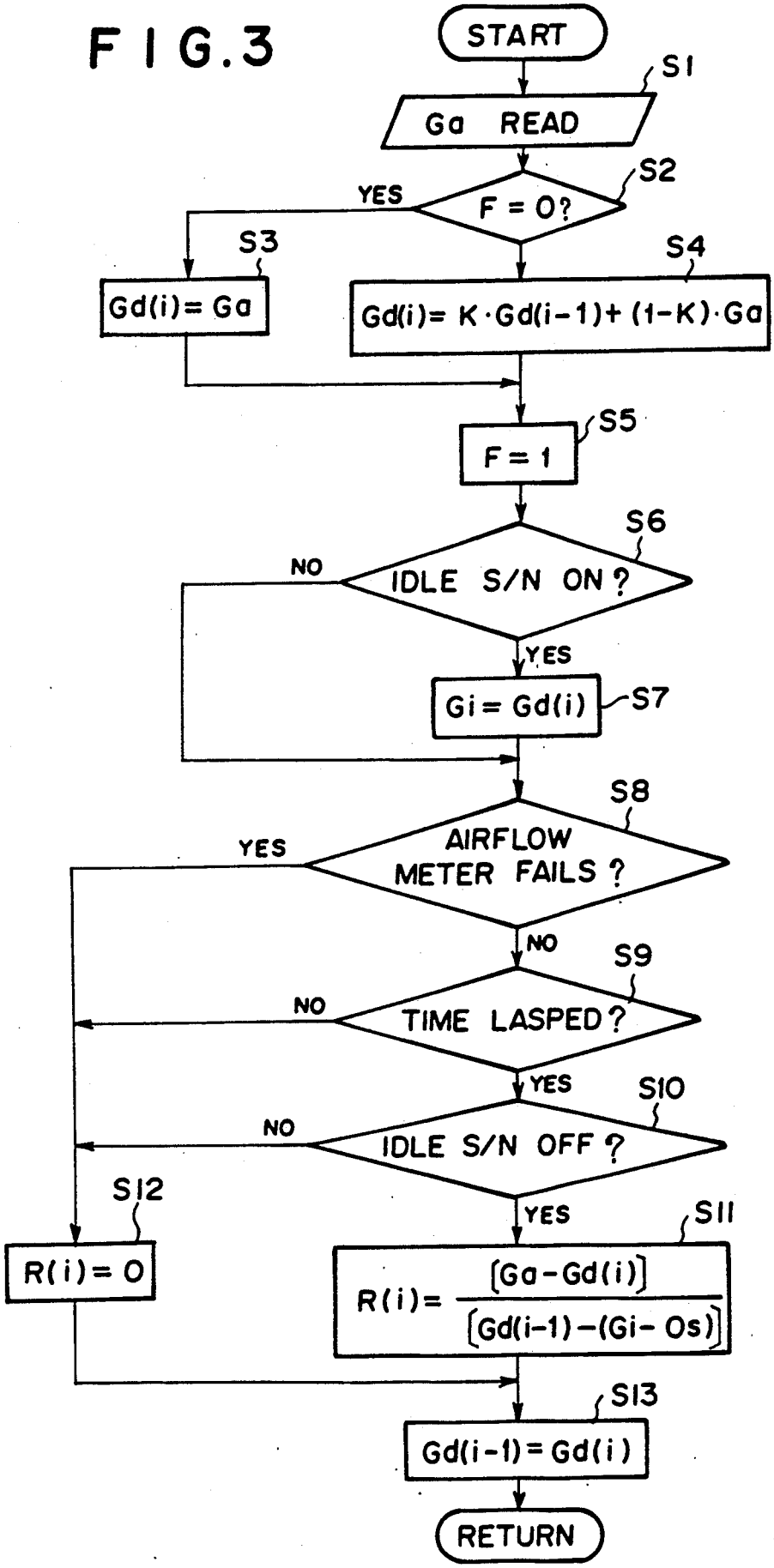
FIGS. 3 and 4 are routines performed by the control unit.
Figure 4:
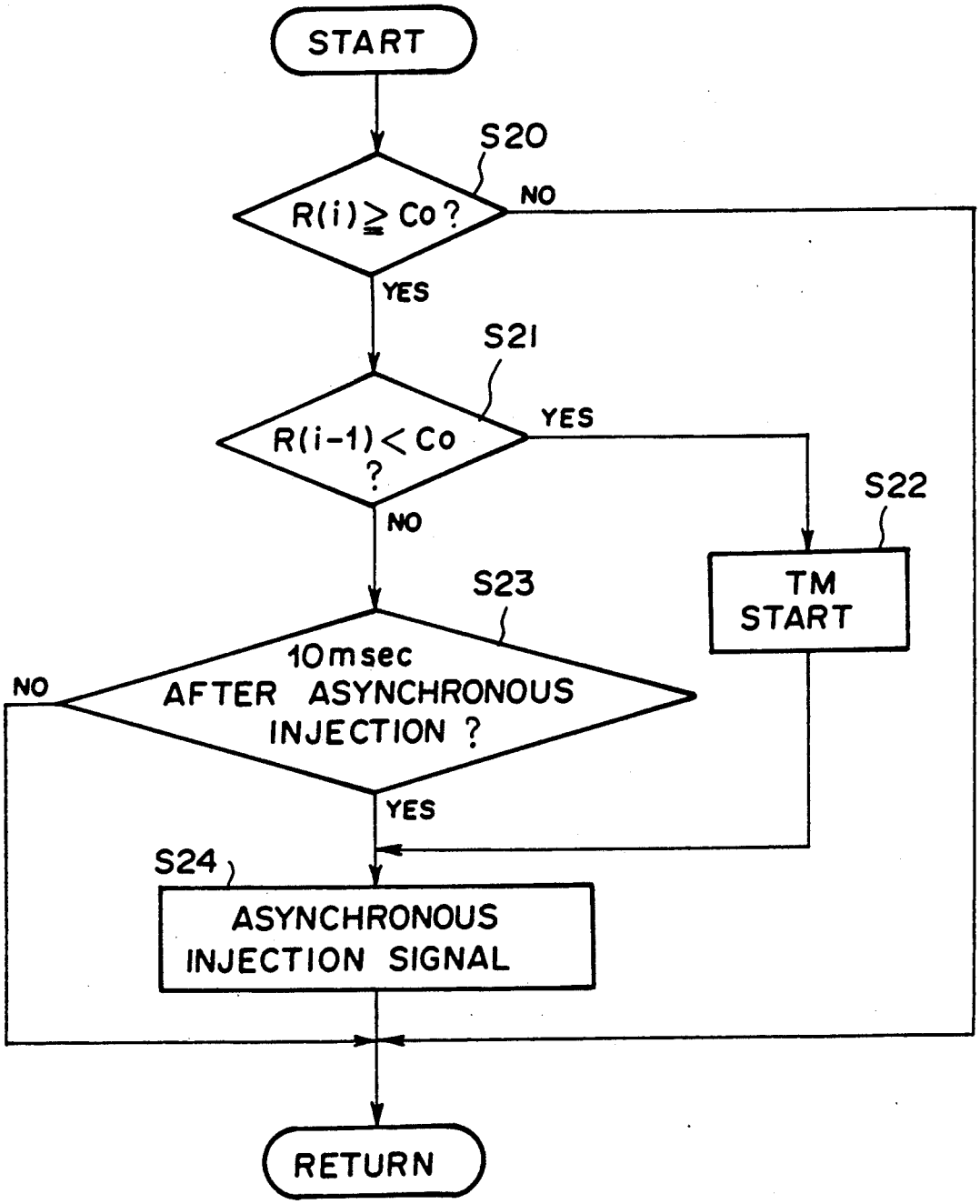

The routine shown in FIG. 3 is a routine for obtaining a ratio of increase R of the amount of intake air which is used for determining whether the engine is being accelerated. In FIG. 3, signs denote the following.

Ga: An actual output of the airflow meter 15 (updated in sequence and stored in a memory in the RAM 30)

Cd(i): A moving average of the actual outputs Ga of the airflow meter 15, Gd(i−1) being the preceding value and Gd(i) being the present value (updated in sequence and stored in the memory in the RAM 30)

K: A predetermined constant, $0<K<1.0$

F: A flag stored in the memory in the RAM 30, F=0 at the initialization

Gi: An output of the airflow meter 15 which represents the amount of intake air during idling and is stored in the memory in the RAM 30

Os: A predetermined small offset value which is subtracted from Gi

R(i): A ratio of increase of the output of the airflow meter 15, R(i−1) being the preceding value and R(i) being the present value In the routine shown in FIG. 3, the control unit 25 first reads the output Ga of the airflow meter 15 and then determines whether the flag F is 0. (steps S1 and S2) The flag F is initialized to 0 at the start of the main routine, and only at the first run, the flag F is 0, and the control unit 25 proceeds to step S3 from step S2. Thereafter, the control unit 25 proceeds directly to step S4 from step S2.

In step S3, the control unit 25 sets, as an initial value, the moving average Gd(i) of the actual output Ga of the airflow meter 15 to the present value of the actual output Ga of the airflow meter 15 as it is. Then the control unit 25 sets the flag F to 1 in step S5. At the second run and thereafter, the flag F has been set to 1, and accordingly, the control unit 25 proceeds directly to step S4 from step S2. In step S4, the control unit 25 smooth the actual output Ga to obtain the moving average Gd(i) according to formula $Gd(i)=K\cdot Gd(i-1)+(1-K)\ Ga$. Since K is a predetermined constant which is larger than 0 and smaller than 1.0, the moving average Gd(i−1) and the actual output Ga are weighted with K and 1−K, and smoothed.

After setting the flag F to 1 in step S5, the control unit 25 determines in step S6 whether the engine is idling, and when it is determined that the engine is idling, the control unit 25 sets in step S7 the value of the output Gi of the airflow meter 15 representing the amount of intake air during idling to the value of the moving average Gd(i) and then proceeds to step S8. Otherwise, the control unit 25 directly proceeds to step S8 from step S6.

In step S8, the control unit 25 determines whether the airflow meter 15 has failed. An interruption handling routine for determining whether the airflow meter 15 has failed (which is not shown) is separately provided and a failure flag which indicates that the airflow meter 15 has failed is set in the memory in the RAM 30. In the interruption handling routine, it is determined that the airflow meter 15 has failed when the actual output Ga of the airflow meter 15 is not in a predetermined range or when the actual output Ga does not change for a predetermined time. In step S8, the control unit 25 determines whether the airflow meter 15 has failed on the basis of the failure flag. When it is determined that the airflow meter 15 has not failed, it is determined in step S9 whether a predetermined time lapses after the engine is started on the basis of a timer which starts as soon as the engine is started. When the predetermined time has lapsed and the output of the airflow meter 15 has been stabilized, the control unit 25 determines in step S10 whether the idle switch 19 is off. When it is determined that the idle switch 19 is off and the engine is not idling, the control unit 25 calculates the ratio of increase R(i) of the output of the airflow meter 15 according to the following formula.

$$R(i)=[Ga-Gd(i)]/[Gd(i-1)-(Gi-Os)]$$

When the engine begins to be accelerated, the value of [Ga−Gd(i)]becomes very large. However, since the ratio of increase R(i) represents the ratio of the present increase of the output of the airflow meter 15 to the preceding increase, it correctly reflects the degree of acceleration.

Instead of [Gd(i−1)−(Gi−Os)], one of the followings may be employed. Gd(i−1)−Gi], Gd(i−1)], [Gd(i)−(Gi−Os)], [Gd(i)−Gi], Gd(i)]

Generally a value which increases and decreases substantially in proportion to the moving average Gd(i) can be employed as "the value derived from the moving average".

After step S11, the control unit 25 proceeds to step S13. When it is determined in step S8 that the airflow meter 15 has failed, or when it is determined in step S9 that the predetermined time has not lapsed yet, or when it is determined in step S10 that the idle switch 19 is not off, the control unit 25 proceeds to step S13 after setting the ratio of increase R(i) to 0 in step S12. In step S13, the control unit 25 updates value of the moving average Gd. Then the control unit 25 returns to the main routine.

Figure 5:
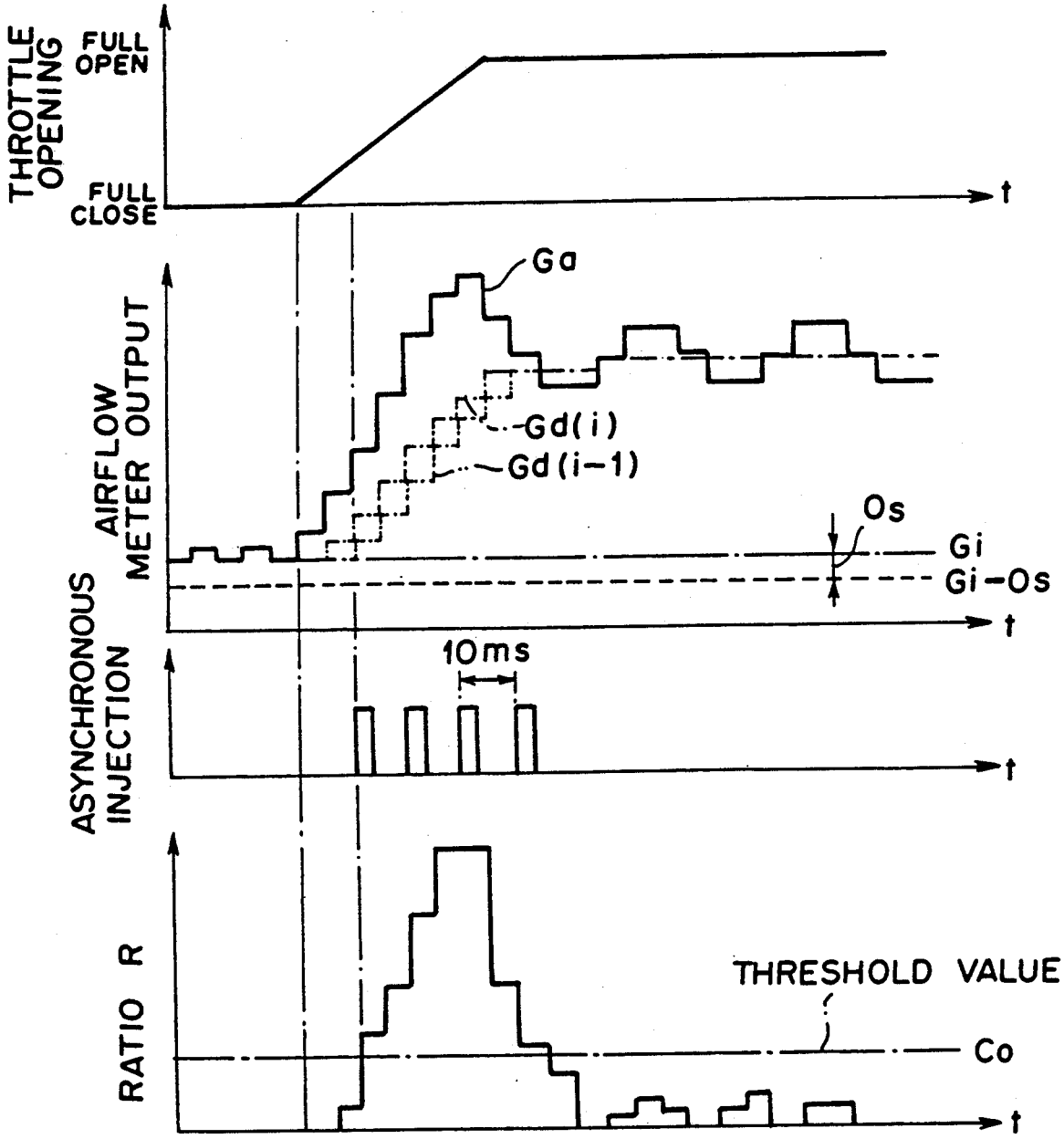
FIG. 5 is a time chart for illustrating the principle of the present invention.
Figure 6:
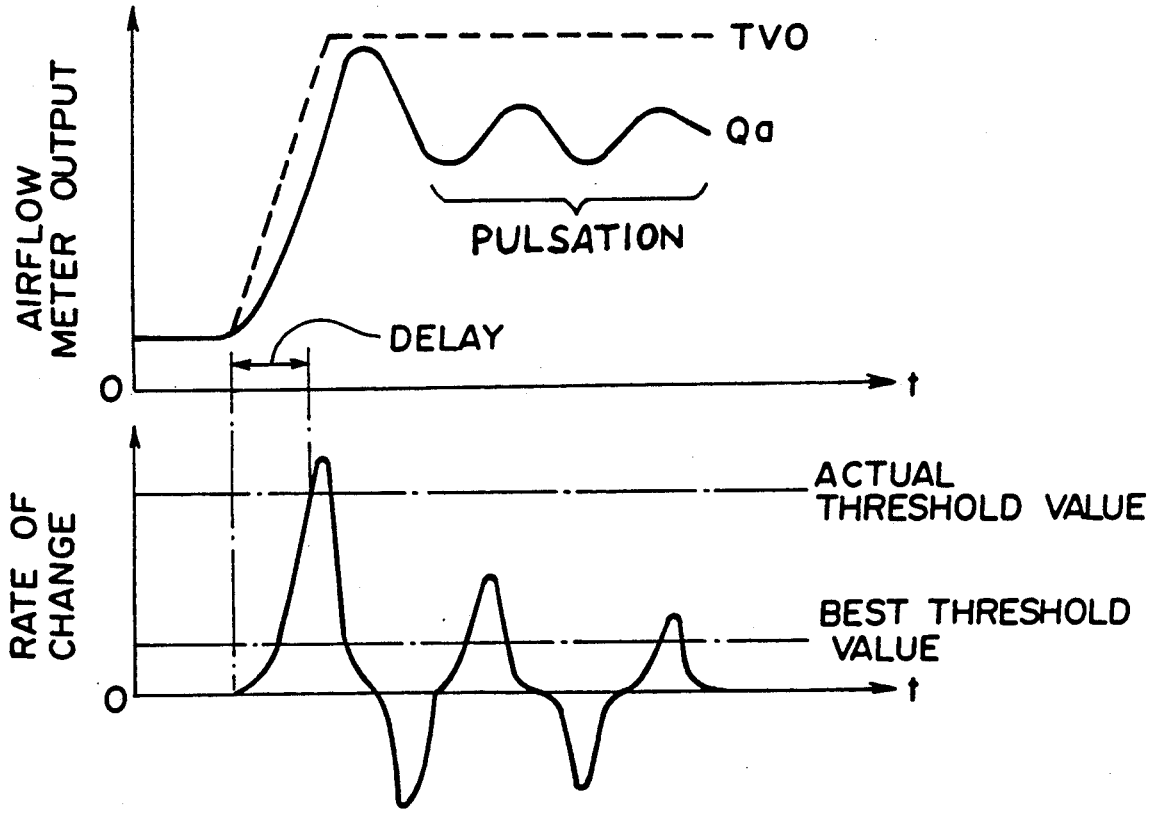
FIG. 6 is a time chart for illustrating the drawback inherent to the prior art.

When the interruption handling routine shown in FIG. 3 is executed at intervals of 5 msec, the actual output Ga of the airflow meter 15, the moving averages Gd(i−1) and Gd(i), the ratio of increase R(i) before acceleration, during acceleration and after acceleration are, for instance, as shown in FIG. 5. As can be understood from FIG. 5, the value of the ratio R(i) during acceleration is very large, while the ratio R(i) do not increase so much even if the output of the airflow meter 15 pulsates after acceleration since the denominator of the formula for calculating the ratio R(i) has become large.

The routine shown in FIG. 4 will be described, hereinbelow. This routine is for determining whether the engine is accelerated and performing the acceleration fuel increase, and is executed after the routine shown in FIG. 3.

The control unit 25 executes the routine at interruption timings every 5 msec, and first determines in step S20 whether the ratio of increase R(i) is not smaller than a predetermined threshold value Co. When it is determined that the former is smaller than the latter, i.e., that the engine is not being accelerated, the control unit 25 immediately returns to the main routine. Otherwise, the control unit 25 proceeds to step S21 and determines whether the preceding ratio of increase R(i−1) is smaller than the predetermined threshold value Co in order to determine whether the engine just begins to be accelerated or is in the course of acceleration. When it is determined that the preceding ratio of increase R(i−1) is smaller than the predetermined threshold value Co, the control unit 25 proceeds to step S24 after starting a timer TM in step S22. On the other hand, when it is determined that the preceding ratio of increase R(i−1) is not smaller than the predetermined threshold value Co, i.e., when it is determined that the engine has been accelerated since the preceding determination, the control unit 25 proceeds to step S24 after it is determined in step S23 that 10 msec has lapsed after the preceding asynchronous fuel injection on the basis of the time TM. In step S24, the control unit 25 outputs a control signal which causes the driving circuit 17*a* to drive the injector 17 to make an asynchronous injection. Thus, as soon as the ratio of increase R(i) turns not smaller than the predetermined threshold value Co, first asynchronous injection is made for all the cylinders and thereafter, asynchronous injection is made every 10 msec. (See FIG. 5)

The injector driving pulse at the asynchronous injection is of a fixed width, and a logical sum of the asynchronous injector driving pulse and a synchronous or regular injector driving pulse is taken.

In the fuel control system of this embodiment, when the engine is being accelerated, the difference [Ga−Gd(i)]increases while the preceding moving average Gd(i−1) is relatively small, and accordingly the ratio R increases. After the acceleration is completed, since the preceding moving average Gd(i−1) has become large, the ratio R is kept relatively small even if the actual output of the airflow meter pulsates and a substantially large difference [Ga−Gd(i)]is generated. Accordingly, when the threshold value Co is set to a proper value, the acceleration of the engine can be accurately detected without misjudgement due to the pulsation of the output of the airflow meter.

Further, when the engine is accelerated from a state where the amount of intake air is relatively small and the moving average Gd(i−1) is small, the value of the ratio R quickly increases and accordingly, acceleration of the engine can be quickly detected, whereby the acceleration fuel increase can be performed in a short time after the beginning of the acceleration.

Though, in the embodiment described above, a hot-wire airflow meter is used, film type airflow meter, a measuring plate type airflow meter or the like may be used. Further, though, in the embodiment described above, the injectors 17 make regular injection for the respective cylinders, they may make regular injection at the same time for all the cylinders. Though, in the embodiment described above, the present invention is applied to an in-line engine, the present invention may be applied to other various engines such as a V-type engine, a rotary piston engine and the like.

We claim:

1. A fuel control system for an engine comprising
an airflow meter which detects an amount of intake air flowing through an intake passage of the engine,
a fuel feed means for feeding fuel to the engine in an amount which is determined according to the amount of intake air detected by the airflow meter,
a moving average calculating means which calculates moving averages of outputs of the airflow meter,
a ratio calculating means which calculates the ratio of the difference between each output of the airflow meter and the moving average to a value derived from the moving average, and
a fuel increase means which causes the fuel feed means to increase the amount of fuel to be fed to the engine when the ratio is not smaller than a predetermined reference threshold value.

2. A fuel control system as defined in claim 1 in which said value derived from the moving average is a value which increases and decreases substantially in proportion to the moving average.

3. A fuel control system as defined in claim 2 in which said value derived from the moving average is a value obtained by subtracting the difference between a value corresponding to the amount of intake air during idling and a predetermined offset value from the preceding value of the moving average.

4. A fuel control system as defined in claim 3 in which said moving average is calculated according to formula $Gd(i)=K.Gd(i-1)+(1-K).Ga$ wherein $Gd(i)$ represents the moving average, $Gd(i-1)$ represents the preceding value of the moving average or a predetermined constant, Ga represents the output of the airflow meter, and K represents a constant which is larger than 0 and smaller than 1.

5. A fuel control system as defined in claim 1 in which said airflow meter is a hot-wire airflow meter.

* * * * *